US006532626B2

(12) United States Patent
Muller et al.

(10) Patent No.: US 6,532,626 B2
(45) Date of Patent: Mar. 18, 2003

(54) ADJUSTABLE HINGE

(75) Inventors: Wolfgang Muller, Lustenau (AT); Markus Albrecht, Lustenau (AT)

(73) Assignee: Grass GmbH, Voralberg (AT)

( * ) Notice: Subject to any disclaimer, the term of this patent is extended or adjusted under 35 U.S.C. 154(b) by 0 days.

(21) Appl. No.: 09/778,480

(22) Filed: Feb. 7, 2001

(65) Prior Publication Data

US 2001/0023519 A1 Sep. 27, 2001

(30) Foreign Application Priority Data

Feb. 14, 2000 (DE) ..... 100 06 587

(51) Int. Cl.[7] ..... E05D 7/04
(52) U.S. Cl. ..... 16/245; 16/238
(58) Field of Search ..... 16/245, 237, 238

(56) References Cited

U.S. PATENT DOCUMENTS

| | | | | | |
|---|---|---|---|---|---|
| 4,359,802 | A | * | 11/1982 | Rock | 16/238 |
| 4,615,072 | A | * | 10/1986 | Lautenschlager, Jr. | 16/238 |
| 4,718,143 | A | * | 1/1988 | Lautenschlager, Jr. | 16/238 |
| 4,720,896 | A | * | 1/1988 | Lautenschlager et al. | 16/382 |
| 5,025,530 | A | * | 6/1991 | Ferrari et al. | 16/236 |
| 5,052,077 | A | * | 10/1991 | Lautenschlager et al. | 16/238 |
| 5,056,189 | A | * | 10/1991 | Brustle et al. | 16/235 |
| 5,159,740 | A | | 11/1992 | Brüstle et al. | |
| 5,210,907 | A | * | 5/1993 | Toyama | 16/258 |
| 6,088,879 | A | * | 7/2000 | Gasser | 16/257 |
| 6,266,848 | B1 | * | 7/2001 | Fraccaro et al. | 16/245 |

FOREIGN PATENT DOCUMENTS

| | | | |
|---|---|---|---|
| DE | 3521812 A1 | * | 1/1987 |
| DE | 3541110 A1 | * | 5/1987 |
| DE | 26 60 736 C2 | | 3/1988 |
| WO | WO 97/22773 | | 6/1997 |

OTHER PUBLICATIONS

International Search Report mailed Feb. 28, 1997 corresponding to PCT/AT 96/00225.

* cited by examiner

*Primary Examiner*—Anthony Knight
*Assistant Examiner*—Alison K. Pickard
(74) *Attorney, Agent, or Firm*—John M. Harrington; Kilpatrick Stockton LLP

(57) ABSTRACT

The invention concerns an adjustable hinge that connects two furniture/cabinet components (door and cabinet body) together by means of a cabinet hinge and baseplate. On the cabinet hinge is a spring snap mechanism and connected on it, a hinge arm. This is connected by an adjustment plate with the baseplate and between the hinge arm and adjustment plate, an adjustment screw is located to adjust the both (bilateral) distances. The adjustment screw is screwed through an enclosed elongated hole in the adjustment plate in a thread borehole in the hinge arm. According to the invention, the adjustment screw is designed as a set screw (thread pin), which has on its one end a device for a releasable coupling with a tool and on the other end has a plate with a larger diameter. The bottom surface side of the plate, thus, rests on the baseplate and on the plate's upper surface, the edge of the adjustment plate's elongated hole. It is preferred that the plate's surfaces and the baseplate's surfaces are formed spherical or cone-shaped and that the edge of the elongated hole's edge is strengthened or reinforced. The invention-related adjustable hinge allows the easy, simple, precise and reproducible adjustment of these lateral distances between the door and cabinet without damage to the hinge, while simultaneously, enabling a simpler, easier and cost effective production of the hinge itself.

10 Claims, 4 Drawing Sheets

ADJUSTABLE HINGE

FIELD OF THE INVENTION

The invention concerns an adjustable hinge.

BACKGROUND OF THE INVENTION

Adjustable hinges of this type serve to connect two cabinet/furniture components to one another in that the adjustable hinge is fastened to a cabinet/furniture component (for example, door) with a cabinet hinge and fastened to another cabinet/furniture component (for example, the cabinet body) with a baseplate. There is a spring mechanism between the cabinet hinge and the baseplate to snap this on and off the cabinet hinge that is fastened to the cabinet/furniture component. On the other hand, a hinge arm is fastened on the other side of the spring mechanism, which is connected to the baseplate by means of an adjustment plate, whose baseplate is then connected to a second cabinet/furniture component.

The distance piece is connected releasable by a stop screw to the hinge arm and to others by a so-called side adjustment screw with which the distance can be set between the hinge arm and the distance piece. Together, with the setting of this distance between the hinge arm and the distance piece, the side movement of the cabinet hinge then goes somewhat perpendicular around to the rest of the hinge, so that the first cabinet/furniture component (for example, door) moves somewhat perpendicular to the second cabinet/furniture component (for example, the body of the cabinet). Consequently, the doors can then be moved laterally in the width of the cabinet in such a manner that the vertical side panels of the cabinet then align with the doors.

DE 2660736 C2 shows an adjustable hinge, according to the above-mentioned type, with a distance piece into which a stop screw and an adjustment screw are screwed. The stop screw then engages through the hinge arm and is screwed down and fixed on the baseplate. The adjustment screw is attached with its ring-shaped groove underneath its screw head in an elongated hole in the hinge arm and can, thus, move by turning the distance piece somewhat in the direction of the screw symmetry line relative to the hinge arm. The distance piece then engages with the flanges into the baseplate's horizontal grooves.

The disadvantage of this version is that between the adjustment screw's ring-shaped groove and the hinge arm and between the distance piece and the baseplate's grooves, there is a relatively large clearance that does not allow exact adjustment. The adjustment screw has a large screw head, resulting in a relatively large overall height. Additionally, the assembly is complicated because the adjustment screw then has to be inserted in the borehole provided in the hinge arm. Afterwards, a piece must be screwed into the thread in the distance piece and, then, must be pushed into the hinge arm's elongated hole. Furthermore, there is not much sturdiness in this connection because the adjustment screw merely rests in an non-reinforced elongated hole in the hinge arm, and the hinge arm can deform flexibly or plastic under the effects of force. As a result of this, again, an exact adjustment cannot be made. Also, the strength and stability are decreased by the adjustment screw's reduction in the area of the cross section because of the ring-shaped groove.

The U.S. Pat. No. 5,159,740, likewise, shows an adjustable hinge with stop screws and adjustment screws, according to the above known general type. As in DE 26 60 736 C2, a stop screw is provided; however, the adjustment screw shows the functional reversal. The elongated hole is now no longer provided in the hinge arm, but instead, in the distance piece in whose elongated hole the adjustment screw's lower ring-shaped groove engages so that the adjustment screw is screwed into the thread in the hinge arm. The elongated hole is formed open to the edge of the distance piece. The distance piece is fastened by tabs and is specially formed as a leaf or compound spring on the baseplate. Again, the disadvantage here is that there is a lot of clearance or play between the adjustment's plate's ring-shaped groove and the distance piece, as well as between the distance piece and the baseplate. There is relatively little durability or strength because the elongated hole is not additionally strengthened and is also open on one side. Here, too, the stability and strength are decreased by the adjustment screw's reduction in the area of the cross section because of the ring-shaped groove. Additionally, only a slight adjustment is possible because by tilting the adjustment screw in the elongated hole, a further adjustment between the hinge arm and the distance piece is no longer possible since the adjustment screw is wedged there.

WO 97/22773 shows a version similar to U.S. Pat. No. 5,159,740 with the same disadvantages. Here, however, an adjustment is also possible somewhat in the longitudinal axis of the distance piece and the hinge arm by means of a complicated mechanism with spiral screw, gear rack and tilting lever. Because of the multitude of these structural components, there is additional play or clearance, which operates in a negative manner on the precise adjustability and sturdiness.

SUMMARY OF THE INVENTION

The task of the invention is to develop an adjustable hinge of the above described type which adjusts between the hinge arm and baseplate or between the distance piece and with it two (cabinet/furniture) components, so that a simple, precise and reproducible adjustment can be made without damaging the hinge, while simultaneously designing a hinge that is simpler, lighter and more economical.

The fundamental characteristic here is the adjustment screw represents a set screw, which has on its one end a device for the releasable coupling with a tool, and, on the other end, has a plate with a larger diameter; whereby, the lower surface of the plate, when assembled in the adjustable hinge, rests on the baseplate and on the plate's upper surface, the edge of the adjustment plate's elongated hole.

The advantage here is that there is practically no clearance or play between the hinge arm and the adjustment plate and that there is only a slight play or clearance between the adjustment plate and baseplate, resulting in an adjustment that is easy, precise and reproducible.

Also here, a simple assembly/disassembly of the adjustment screw is Guaranteed because no threading of the adjustment screw's ring-shaped groove into the elongated hole, perhaps by additional bore holes in the hinge arm, is necessary.

In a preferred embodiment of the invention, the plate's surface bottom side and/or surface upper side are designed spherical or cone-shaped.

This offers the advantage that, independently from the adjustment path, the bearing surface between the adjustment screw's plate and the adjustment plate always has an approximately constant size and, thus, increases the durability and service life and, additionally, guarantees an accurate, easy and reproducible adjustment.

Furthermore, it is preferred that this bearing surface in the bearing area of the plate on the baseplate is designed, likewise, spherical or cone-shaped, to fit the plate shape. Because of this, the bearing surface is increased and the plate is stabilized on the baseplate.

Here the advantage is that the clearance or play is almost constant, which again, results in a simple, precise and reproducible adjustment process. That also rules out a tilting and with that, a wedging of the adjustment screw in the-elongated hole, because the ring-shaped groove is missing completely with this state-of technology, and, so, larger range of adjustment can be made.

It is preferred that if the elongated hole in the adjustment plate is designed closed, thus, an enclosed opening by the material of the adjustment plate and not as an open release or catch, which runs openly to the edge of the adjustment plate. This results in additional advantages with regard to the adjustment plate's strength and stability and, thus, the entire hinge. This embodiment of the adjustment plate with an closed elongated hole is possible only due to the newly developed adjustment screw, because it no longer has a radial recess by means of which it can be threaded into an open release in the adjustment plate and is retained. Instead, this adjustment screw can now simply be guided from below into the closed elongated hole and screwed into the hinge arm, and then, rests on the baseplate with its plate.

Additionally, form embossing, ripples and/or waves and/or bending can be provided on the edge of the elongated hole in the adjustment plate towards the plate as additional reinforcement of the elongated hole's edge.

This makes it possible to achieve cost-efficient construction and to have less weight, because only a small sheet plate thickness is sufficient to attain strength and sturdiness.

The objectives of the present invention result not only from the subject matter of the individual patent claims, but also from the various combinations of the individual patent claims.

All records, documents and evidence, including the abstract, open and disclosed statements, declarations, indications, characteristics and features, especially those embodiments represented in the drawings, will be claimed as fundamental and significant to the invention, as far as the claims, individually or in combinations, as relative to the position that the technology is new.

The invention at hand will be explained more precisely by the various embodiments and versions shown by the representational drawings. Additional significant features, characteristics and advantages of the invention will be concluded form the drawings and their descriptions.

DETAILED DESCRIPTION

Figure 1:
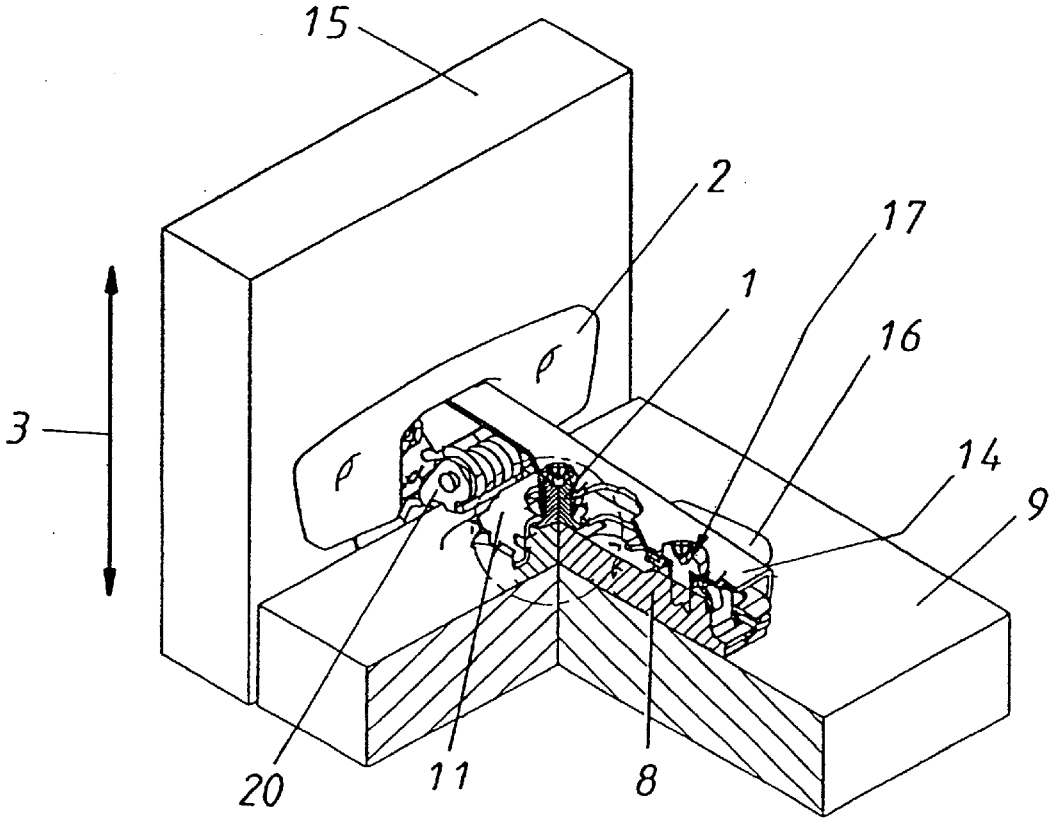
FIG. 1: a perspective view of an invention-related adjustable hinge in the assembled state.

FIG. 1 is a perspective representation of an invention-related adjustable hinge in the assembled state in which the door (15) is connected to the cabinet (9) by an adjustable hinge.

Here, the cabinet hinge (2) of the adjustable hinge is attached by the corresponding fastening elements to the door (15) and the baseplate (8) is connected by the likewise corresponding connection elements in the plate (16) to the cabinet (9), so that the plate (16) is connected in one piece with the baseplate (8).

Then a spring snap-mechanism (20) is attached to the cabinet hinge (2) and should make it possible to "snap" open the door (15) about 90° in relation to the cabinet (9). This spring snap-mechanism (20) has, here, two angled arms, which are attached respectively by two axes on the cabinet hinge (2) and by two other axes on the hinge arm (14). The spring loading occurs here because a torsion leg-spring is attached around one of the axes (preferably one of the hinge arm's [14] axis), which supports itself on one of the angled arms and to the others on the hinge arm (14).

The hinge arm (14), itself, is then connected by a stop screw (17) to the adjustment plate (11). This stop screw (17) is inserted by a corresponding elongated hole in the form of a closed opening through the hinge arm (14) and is screwed into a corresponding threaded bore hole in the adjustment plate (11). A relative adjustment of the hinge arm (14) to the adjustment plate (11) in the length-wise direction can be accomplished because of this stop screw. Both these parts can be screwed tightly to others. In order to achieve a better retention of both these parts to each other, the hinge arm (14) has a respective rippling on the related side on its adjustment plate (11), which then engages into the fitting rippling upper side of the adjustment plate (11).

The adjustment plate (11) is designed u-shaped; whereby, even more projections are located on the u-shanks in 90° angles and the adjustment plate (11) is designed springy in approximately the direction of the stop screw's (17) symmetry axis and has a nose-shaped hook, so that this adjustment plate (11) can be clipped on, releasable, by a known art and manner, on the baseplate (8). No tool is necessary for this and this results in a very quick and easy assembly.

The baseplate (8), itself, is then connected by corresponding connection elements to the cabinet (9), so that an additional plate (16) can be provided on the baseplate (8), which the connection elements go through.

Figure 2:
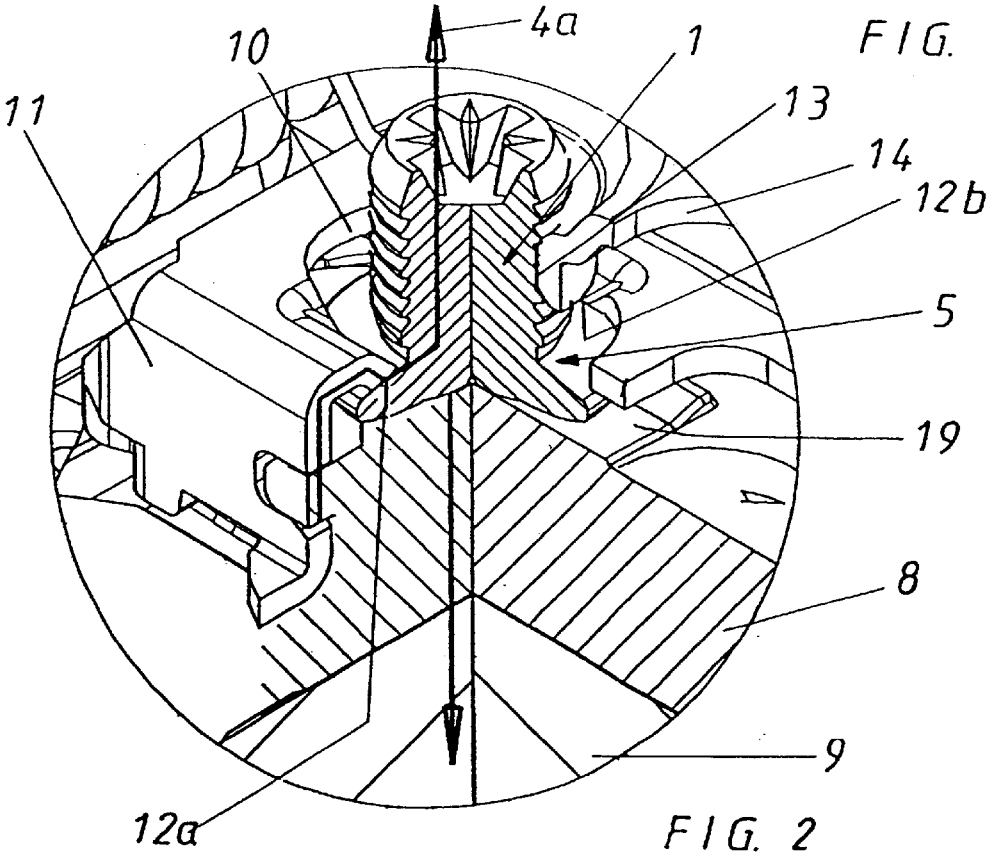
FIG. 2: an enlarged view of the adjustment screw area, according to FIG. 1.

FIG. 2 is an enlarged representation of the adjustment screw (1) area, according to FIG. 1.

Shown here is the elongated hole (10) is designed as a closed opening through the adjustment plate (11) and in its edge-side area is contorted downward so that the contact surfaces (12) are made, which rest and fit on the adjustment screw's (1) plate's (5) surface (6).

This makes it possible for both lengthwise sides of the adjustment plate's (11) elongated hole (10) rest on the contact surfaces 12*a* and 12*b* on the plate's (5) upper side (6) of the adjustment screw (1) or else, simply, one side with the contact surface 12*a* or 12*b*, depending on the tolerance position of the concentric running and nut thread position. The advantage, here, is that the production tolerance in the concentric running and nut thread position is divided on the sides, and, with that, simply halving the tolerances.

Furthermore, FIG. 2 shows that both the upper sides (6), as well as the bottom sides (7) of the plate (5) of the adjustment screw (1) is in a bent form, so that the bottom side (7) then fits tightly on a corresponding, likewise bent, formed contact surface (19) of the baseplate (8). As a result of this, a large and constant contact surface is made between the bottom side (7) of the plate (5) of the adjustment screw (1) and the contact surface (19) of the baseplate (8).

Moreover, FIG. 2 illustrates that a high level of structural stability is achieved by the force flux (4), which has the least amount of parts over the shortest distance possible with the least possible force deviation or turning. This also helps to avoid excessive use or overloading thinner (sized) parts, guaranteeing a corresponding durability, sturdiness and reproducibility of lateral adjustments of adjustable hinges.

The pressure load in direction **(4*a*) then presses the side adjustment screw (1) over the baseplate (8) on the cabinet (9)** and, to be precise, straight-lined without deviation.

The tension load in direction **(4*b*) results in the force flux in the cross-sectional plane by the center of the side adjustment screw (1); that is, on the shortest distance from the baseplate (8) on the hinge arm (14)**.

Figure 3A:
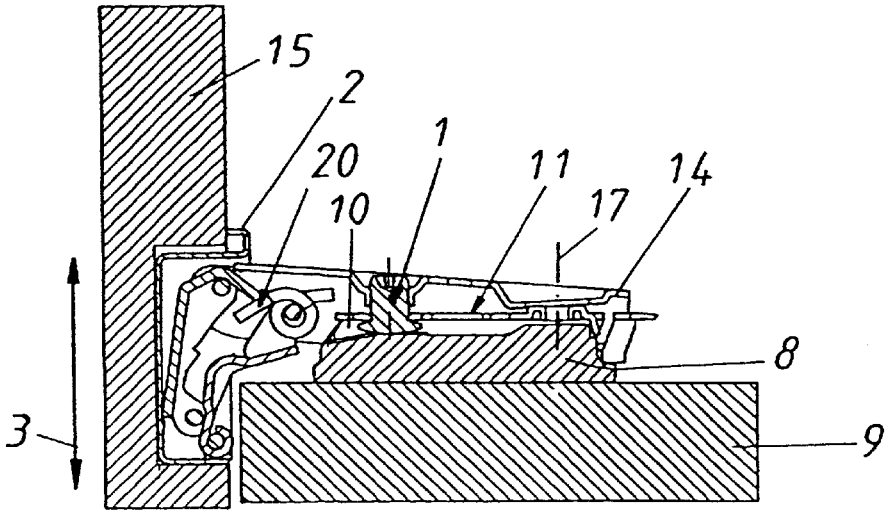
FIG. 3*a*: a section through the longitudinal axis of the invention-related adjustable hinge in the assembled state, according to FIG. 1, already adjusted.
Figure 3B:
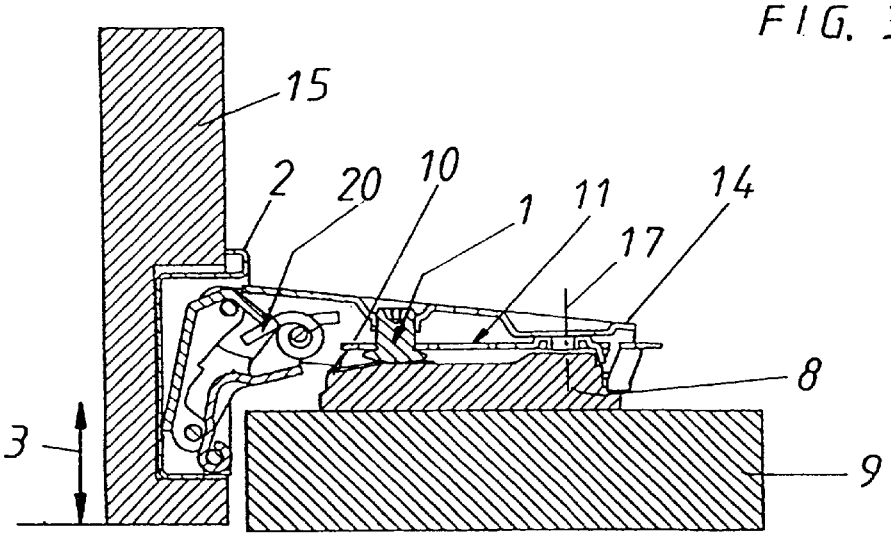
FIG. 3*b*: a section through the longitudinal axis of the invention-related adjustable hinge in the assembled state, according to FIG. 1, with the adjustment screw tightened.

FIGS. **3*a* to 3*c*, respectively show a section through the longitudinal axis of the invention-related adjustable hinges in the assembled state, according to FIG. 1; whereby, FIG. 3*a* represents the door (15) and cabinet (9) that are already adjusted; FIG. 3*b* embodies the adjustment screw (1) that is completely screwed-in; and, FIG. 3*c* shows the adjustment screw (1)** that is complete "screwed-out".

The adjustment (3) can also be set by screwing the adjustment screw (1) in or out of the thread bore hole of the hinge arm (14), so that the relative distance of the hinge arm (14) to the adjustment plate (11), respectively, to the baseplate (8) and be directly turned around over the spring snap-mechanism (20) and the cabinet hinge (2) in the door (15), and, as in FIGS. **3*a* to 3*c***, the door can be moved from below to above, or the reverse.

By screwing the adjustment screw (1) in or out, the door (15) is moved laterally to the cabinet (9), achieving the side adjustment. This adjustment can result from a tightly screwed-in stop screw (17) so that the hinge arm (14) and the adjustment plate (11), instead of the stop screw (17), cannot be moved towards each other. This fixing or catch occurs when the stop screw (17) is completely screwed into the baseplate (8), where it is then fixed securely.

Figure 3C:
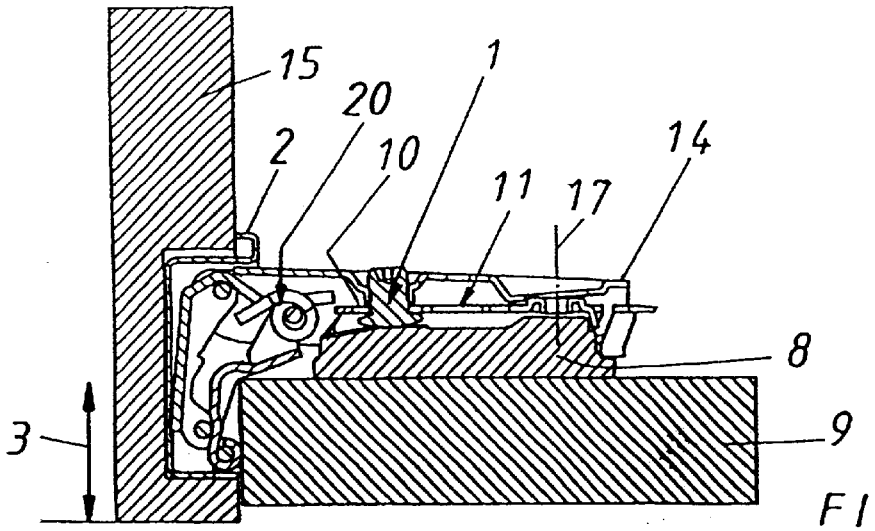
FIG. 3*c*: a section through the longitudinal axis of the invention-related adjustable hinge in the assembled state, according to FIG. 1, with the adjustment "screwed out"

FIG. **3*b* shows the door (15) adjusted somewhat high, in relation to the cabinet (9) and in FIG. 3*c* the door (15) is adjusted somewhat lower in comparison to the cabinet (9)**.

Likewise, FIGS. **3*a* to 3*c* illustrate that, according to the adjustment, the adjustment screw (1) then modifies its axle position in relation to the baseplate (8) and to the adjustment plate (11), which then results in the distance between the hinge arm (14) and the adjustment plate (11), or respectively, the baseplate (8) being changed. More exactly, the angle between the hinge arm (14) and the adjustment plate (11), or respectively, the baseplate (8) is modified since it is these three above-mentioned parts in the area of the stop screw (17)** that are fixed securely and immovable to one another.

In comparison to FIG. **3*a*, the adjustment screw (1) in FIG. 3*b* is also slightly tilted to the right and the adjustment screw, according to FIG. 3*c*, in comparison to FIG. 3*a* is slightly tilted left, so that, however, the bearing surface of the bottom side (7) of the adjustment screw's (1) plate (5) always remains constant because of its bent or crooked shape and because of the bent or crooked shape of the bearing surface (19) of the baseplate (8)**.

Figure 4:
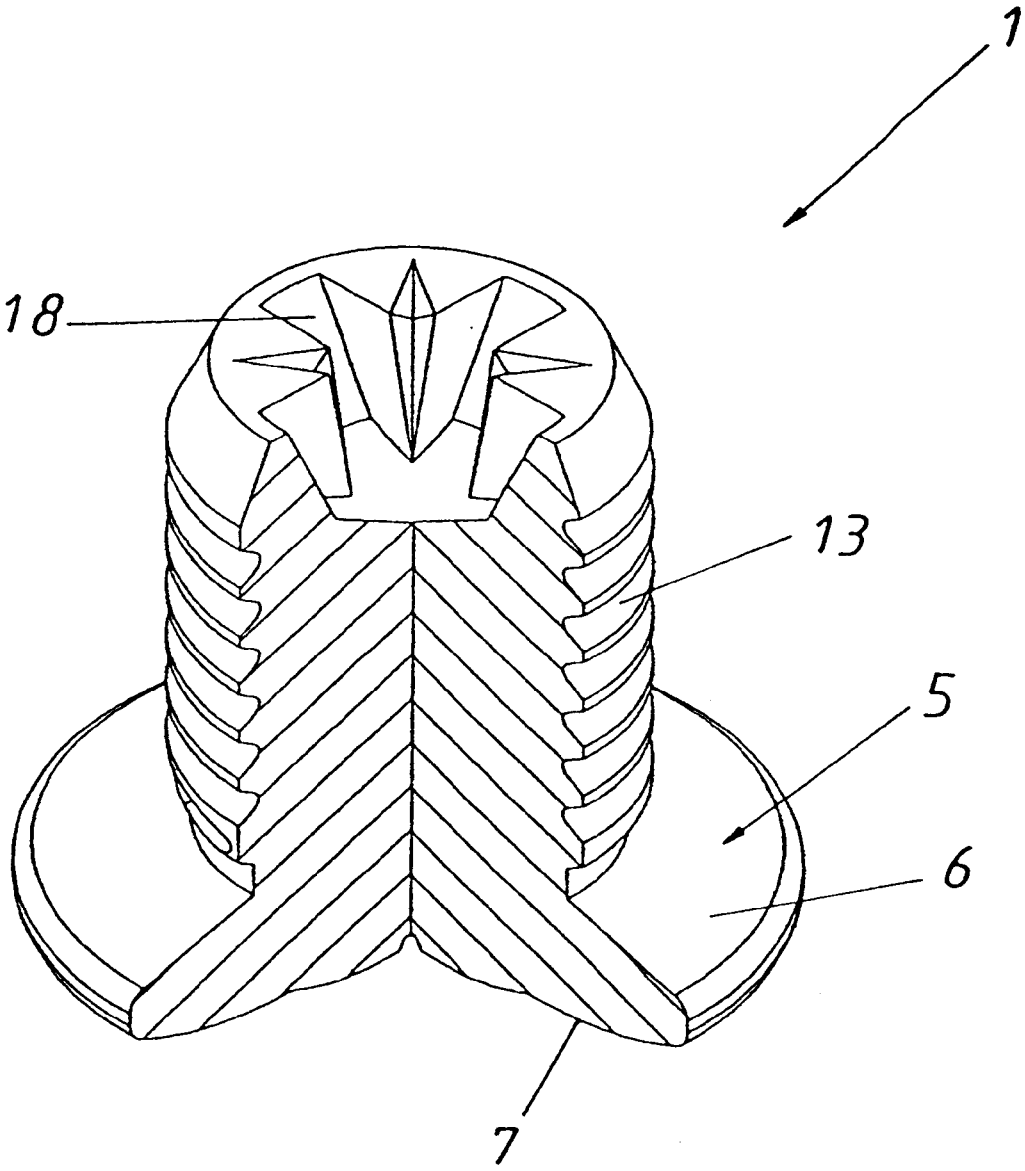
FIG. 4: a perspective view of an invention-related adjustment screw.

Then, finally, FIG. 4 shows a perspective embodiment of the invention-related adjustment screw (1), which illustrates the adjustment screw is basically designed as a set screw (thread pin), and that this adjustment screw (1) has on its upper end a device (18) in the shape of a cross-shaped recess in which to insert a tool, and on the lower free end has a screw plate (5) with a large diameter.

FIG. 4 also illustrates that the upper side (6) and the bottom side (7) of the screw plate (5) are designed bent or crooked (for example, spherical or cone-shaped or any other fee shape surface). This surface corresponds then with the bearing surface (19) of the baseplate (8), which is natural formed most like the shape of the bottom side (7) of the bottom side (7) of the plate (5).

The diameter of this plate (5) corresponds somewhat to doubled the thread's center diameter (13) of the adjustment screw (1), and the height of the plate (5) corresponds somewhat to a fifth of the total length of the adjustment screw (1). These dimensions are simply preferred size and can deviate depending on the embodiment.

Figure 5:
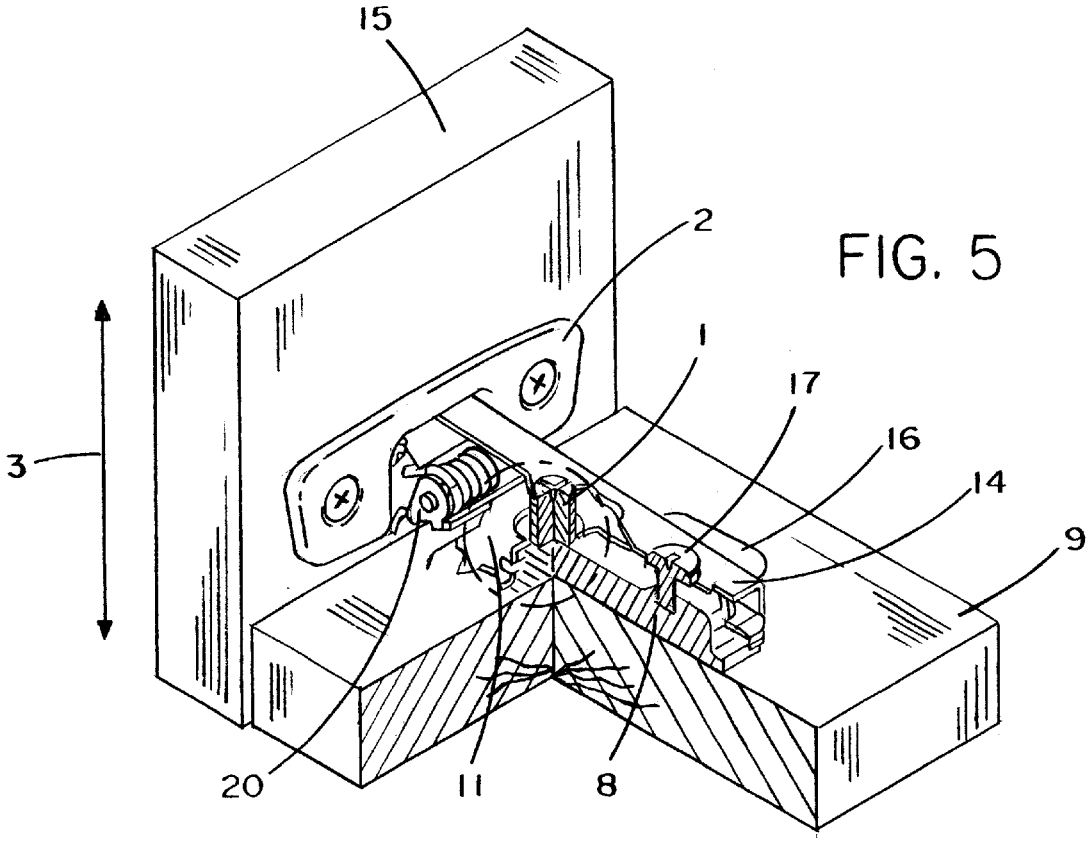
FIG. 5: a perspective view of an invention-related adjustable hinge in the assembled state.
Figure 6:
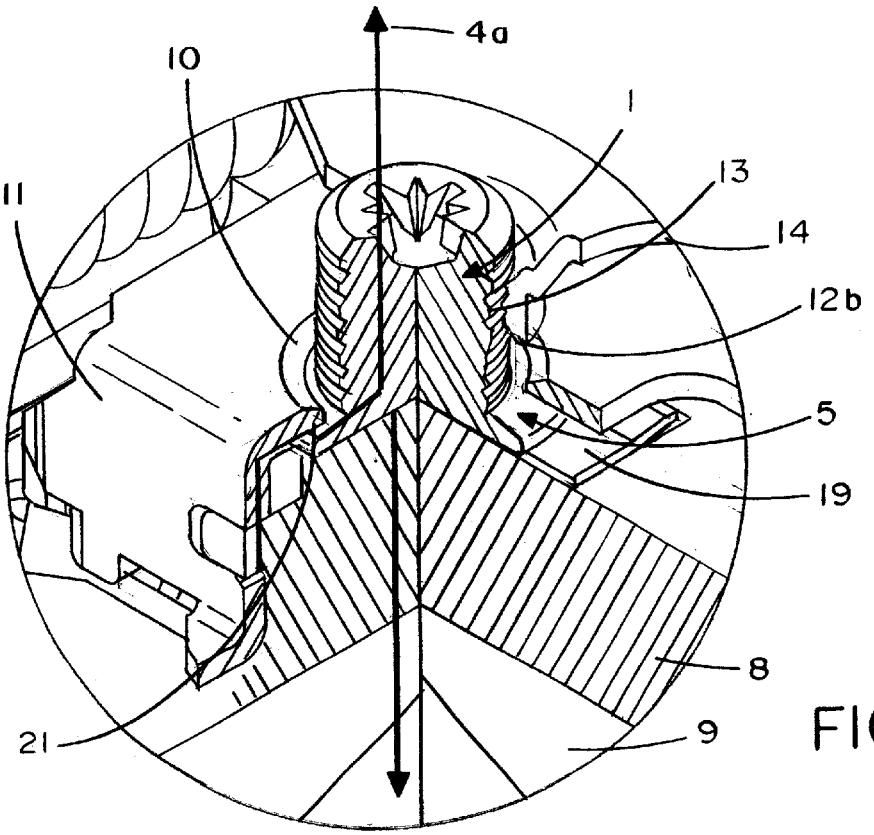
FIG. 6: an enlarged view of the adjustment screw area, according to FIG. 5.

FIGS. 5 and 6 show perspective views of another embodiment of an invention-related adjustable hinge in the assembled state. FIG. 5 shows the hinge (2) connecting the door (15) to the cabinet (9) as shown in FIG. 1. Accordingly, the numbers in FIGS. 5 and 6 correspond to the numbers in FIGS. 1 and 2. However, as can be seen in FIG. 6, this embodiment further comprises bending or embossing (21) on the edge of the elongated hole (10) in the adjustment plate (11) as additional reinforcement of the elongated hole's edge.

DRAWING LEGEND

| | |
|---|---|
| 1. | Adjustment screw |
| 2. | Cabinet hinge |
| 3. | Adjustment |
| 4. | Force flux, Pressure 4a, Pull 4b |
| 5. | Screw plate |
| 6. | Upper side from 5 |
| 7. | Bottom side from 5 |
| 8. | Baseplate |
| 9. | Cabinet |
| 10. | Elongated hole |
| 11. | Adjustment plate |
| 12. | Contact surfaces, 12a, 12b |
| 13. | Thread |
| 14. | Hinge arm |
| 15. | Door |
| 16. | Plate |
| 17. | Stop screw |
| 18. | Device for tool |
| 19. | Bearing surface |
| 20. | Spring snap mechanism |
| 21. | Elongated hole profile |

What is claimed is:

1. Adjustable hinge to connect two furniture/cabinet parts (9,15) by means of a cabinet hinge (2) and a baseplate (8); whereby, a spring snap mechanism (20) and on it a hinge arm (14) is fastened on the cabinet hinge (2) and the hinge arm is fastened to the baseplate (8) by means of an adjustment plate (11) and, additionally, there is an adjustment screw (1) between the hinge arm (14) and adjustment plate (11) to adjust both bilateral distances in which the adjustment screw (1) is screwed into an elongated hole (10) in the adjustment plate and in a threaded bore hole in the hinge arm is characterized by the adjustment screw (1) embodied as one of a set screw or threaded pin having a shaft comprising a threaded portion and a non-threaded portion, said non-threaded portion having a substantially uniform diameter, one end of the shaft has a device (18) for a releasable coupling with a tool and the other end of the shaft has a plate (5) with a larger diameter; and, a bottom surface (7) of the plate (5) rests on the baseplate (8) and an upper surface (6) of the plate (5) contacts the edges of the elongated hole (10) in the adjustment plate (11) whereby a secure fit is provided between the hinge arm (14) and adjustment plate (11) and a slight clearance is provided between the adjustment plate (11) and baseplate (8).

2. Adjustable hinge, according to claim 1, is characterized by at least one of the bottom surface (7) or the upper surface (6) of the plate (5) is designed spherical or cone-shape.

3. Adjustable hinge, according to claim 1, is characterized by a bearing surface (19) in the area of the plate's bottom (7) surface on the baseplate (8) that is, likewise, designed spherical or cone shaped, fitting to the plate's shape.

4. Adjustable hinge, according to claim 1, is characterized by the elongated hole (10) that is formed as a closed opening through the adjustment plate (11).

5. Adjustable hinge according to claim 1 is characterized by the edges of the elongated hole in the adjustment plate having a profile of at least one of an embossing, ribbing, fluting, distortions, or waves in the plate direction to additionally strengthen the edges of the elongated hole.

6. Adjustable hinge, according to claim 1, is characterized by the adjustment screw (1) that is located on a side close to the spring snap mechanism (20) and, the cabinet hinge (2).

7. Adjustable hinge, according to claim 1, is characterized by the adjustment screw (1) that is a pressed part.

8. Adjustable hinge, according to claim 1, is characterized by a stop screw (17) that is additionally located between the hinge arm (14) and an adjustment plate (11).

9. Adjustable hinge, according to claim 8, is characterized by the stop screw (17) that is inserted through an elongated hole in the hinge arm (14) and screwed into a thread bore hole in the adjustment plate (11).

10. Adjustable hinge, according to claim 8, is characterized by the stop screw (17) that is distanced away from the spring snap mechanism (20) and, the cabinet hinge (2).

* * * * *